US012270298B2

(12) United States Patent
Macea et al.

(10) Patent No.: US 12,270,298 B2
(45) Date of Patent: Apr. 8, 2025

(54) NATURAL HYDROGEN GAS SAMPLING SYSTEM AND METHOD

(71) Applicant: Expro North Sea Limited, Reading (GB)

(72) Inventors: Dora Mercedes Piedrahita Macea, Houston, TX (US); Omotayo Fagade, Houston, TX (US); Elkin Antonio Colorado Ramirez, Houston, TX (US); Jaime Rodriguez Ardila, Houston, TX (US); Ever Nicolás Camelo Parra, Houston, TX (US)

(73) Assignee: EXPRO NORTH SEA LIMITED, Reading (GB)

( * ) Notice: Subject to any disclaimer, the term of this patent is extended or adjusted under 35 U.S.C. 154(b) by 0 days.

(21) Appl. No.: 18/679,974

(22) Filed: May 31, 2024

(65) Prior Publication Data

US 2024/0401478 A1 Dec. 5, 2024

Related U.S. Application Data

(60) Provisional application No. 63/506,148, filed on Jun. 5, 2023.

(51) Int. Cl.
*E21B 49/08* (2006.01)

(52) U.S. Cl.
CPC ..... *E21B 49/0875* (2020.05); *E21B 49/083* (2013.01)

(58) Field of Classification Search
CPC ..... E21B 49/0875; E21B 49/083
See application file for complete search history.

(56) References Cited

U.S. PATENT DOCUMENTS 3,943,750 A 3/1976 McLaughlin
5,150,622 A 9/1992 Vollweiler
5,452,763 A * 9/1995 Owen ..... E21B 43/2605 204/278
5,543,623 A 8/1996 Everett et al.
(Continued)

FOREIGN PATENT DOCUMENTS

CN 211348226 U * 8/2020
CN 111749685 A 10/2020
(Continued)

OTHER PUBLICATIONS

Iso Tech Iso Tube product https://isotechlabs.com/customersupport/samplingprocedures/WellSM.pdf (Year: 2019).*
(Continued)

*Primary Examiner* — Natalie Huls
(74) *Attorney, Agent, or Firm* — MH2 Technology Law Group, LLP

(57) ABSTRACT

A method for sampling and measuring a hydrogen concentration of a gas in a subsurface formation includes boring a hole in the subsurface formation using a drill string. A gas probe is coupled to a lower end of the drill string. The method also includes opening the gas probe to collect the gas from the subsurface formation. The method also includes drawing the gas up through the drill string after the gas probe is opened. The method also includes measuring the hydrogen concentration of the gas after the gas is drawn up.

15 Claims, 13 Drawing Sheets

(56) References Cited

U.S. PATENT DOCUMENTS

| | | | | |
|---|---|---|---|---|
| 8,763,697 | B2 | 7/2014 | Surguchev et al. | |
| 9,005,528 | B2 | 4/2015 | Coleman et al. | |
| 9,146,224 | B2 | 9/2015 | Coleman et al. | |
| 9,234,822 | B2 | 1/2016 | Coleman et al. | |
| 9,321,052 | B2 | 4/2016 | Coleman et al. | |
| 10,077,139 | B2 | 9/2018 | Coleman | |
| 10,103,395 | B2 | 10/2018 | Pollica et al. | |
| 11,022,527 | B2 | 6/2021 | Coleman et al. | |
| 11,530,603 | B2 | 12/2022 | Gates et al. | |
| 2003/0098156 | A1* | 5/2003 | Follini | E21B 17/1014 166/264 |
| 2020/0182019 | A1 | 6/2020 | Wang et al. | |
| 2023/0050823 | A1 | 2/2023 | Darrah et al. | |
| 2023/0077276 | A1 | 3/2023 | Vinegar et al. | |

FOREIGN PATENT DOCUMENTS

| | | | | | |
|---|---|---|---|---|---|
| CN | 113219129 | A | * | 8/2021 | |
| CN | 114441282 | A | | 5/2022 | |
| EP | 1054135 | B1 | * | 8/2005 | B63B 27/20 |
| JP | 2538272 | B2 | | 9/1996 | |
| KR | 20230025095 | A | | 2/2023 | |
| WO | 2008128331 | A1 | | 10/2008 | |
| WO | 2023019011 | A1 | | 2/2023 | |
| WO | WO-2023192219 | A1 | * | 10/2023 | |

OTHER PUBLICATIONS

Stanford University, Natural Hydrogen, Basin Processes and Subsurface Modeling, Stanford Doerr School of Sustainability, 1 page.

Natural Hydrogen Energy LLC, © 2019 Natural Hydrogen Energy LLC, https://nh2e.com/, 5 pages.

* cited by examiner

NATURAL HYDROGEN GAS SAMPLING SYSTEM AND METHOD

CROSS-REFERENCE TO RELATED APPLICATIONS

This application claims priority to U.S. Provisional Patent Application No. 63/506,148, filed on Jun. 5, 2023, which is incorporated by reference herein.

BACKGROUND

Hydrogen is generated by a natural geochemical process inside the Earth's crust, because of which, this it is a sustainable and inexhaustible source. The gas contains no carbon and, when burned, produces only water. This natural hydrogen has enormous potential as a clean and renewable energy fuel source, with a significantly low carbon footprint. Also, it would remove the need for clean water, which is used during green hydrogen electrolysis, and eliminate the need for expensive Carbon Capture and Storage (CCS) associated with blue hydrogen. Naturally occurring or geological hydrogen has largely been overlooked because it was assumed rare or too difficult to extract. Instead of drilling for fossil fuel, the present invention proposes to drill directly for natural hydrogen, and no fracking would be required. In certain subsurface applications, it may be useful to measure natural hydrogen gas concentrations in a formation. Natural hydrogen gas is sometimes referred to as "white" hydrogen, as contrasted with gray, blue, turquoise, and green hydrogen types, which are more common and are typically generated in industrial processes. But industrially produced hydrogen consumes energy for its production, thus having a large carbon footprint. Natural hydrogen "seeps" in subsurface formations may provide a fuel source for non-carbon-based energy, among other environmental benefits.

The sensitive nature of hydrogen gas is a substantial limitation of this gas. Hydrogen gas is highly inflammable, explosive in nature, has high diffusion rate, and is unstable. These features are significant hindrances to processes of sampling, measurement, monitoring, maintaining purity, storage and transportation of this gas. The present disclosure is directed to overcoming the disadvantages of the existing limitations associated with the sensitive nature of hydrogen gas. The present invention thus seeks to provide simple and efficient methods and systems for natural hydrogen sampling and measurement, from subsurface formation.

SUMMARY

The accompanying drawing, which is incorporated in and constitutes a part of this specification, illustrates an embodiment of the present teachings and together with the description, serves to explain the principles of the present teachings. In the figures:

A method for sampling and measuring a hydrogen concentration of a gas in a subsurface formation is disclosed. The method includes boring a hole in the subsurface formation using a drill string. A gas probe is coupled to a lower end of the drill string. The method also includes opening the gas probe to collect the gas from the subsurface formation. The method also includes drawing the gas up through the drill string after the gas probe is opened. The method also includes measuring the hydrogen concentration of the gas after the gas is drawn up.

A system for sampling and measuring a hydrogen concentration of a gas in a subsurface formation is also disclosed. The system includes a drill string having a gas probe coupled to a lower end thereof. The gas probe is configured to open, which allows the gas from the subsurface formation to flow up through the drill string. The system also includes a manifold coupled to the drill string. The manifold includes a metering device, a suction device, and a collection vessel. The metering device measures the hydrogen concentration of the gas. The suction device draws the gas from the drill string into the collection vessel.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
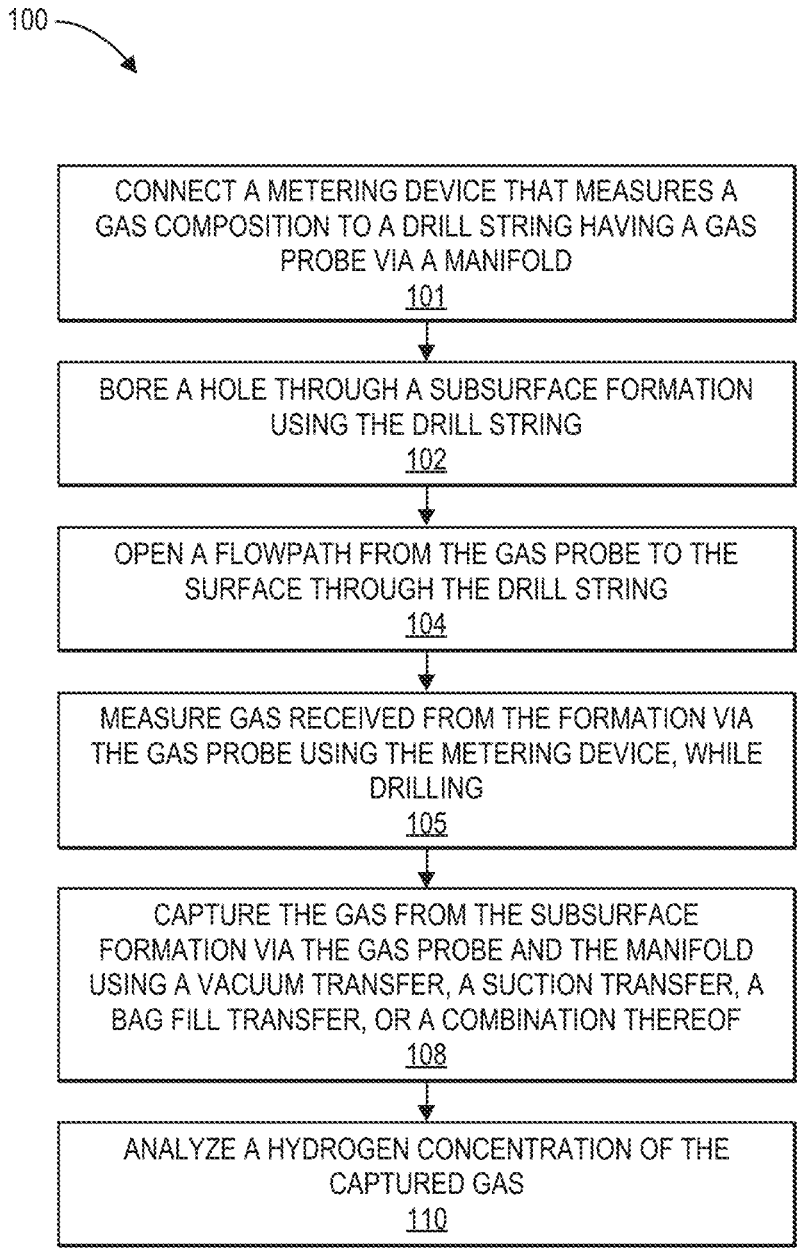
FIG. 1 illustrates a flowchart of a method for measuring a hydrogen gas concentration in a subsurface formation, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. The following description is merely a representative example of such teachings.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

FIG. 1 illustrates a flowchart of a method 100 for measuring a gas concentration in a subsurface formation, according to an embodiment. The gas concentration may specifically be hydrogen ($H_2$). Alternatively, an oxygen ($O_2$) gas concentration, a carbon dioxide ($CO_2$) gas concentration, or a combination thereof may also be included. An illustrative order of the method 100 is provided below; however, one or more steps may be performed in a different order, simultaneously, repeated, or omitted.

The method 100 may include connecting a metering device to a drill string having a gas probe at its distal (e.g., lower) end, as at 101. The metering device may measure a gas composition in the subsurface formation.

Figures 2A, 2B, 2C:
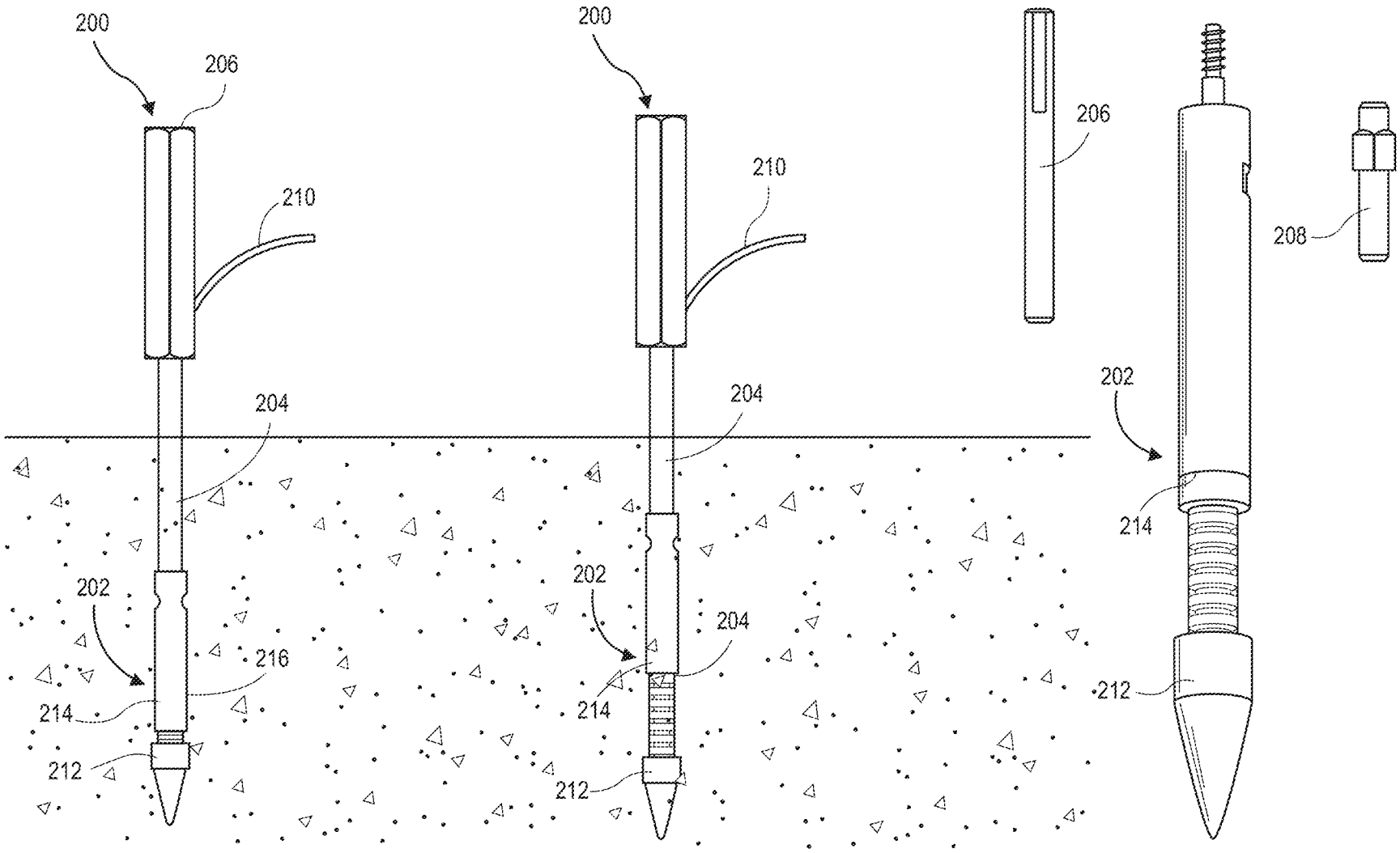
FIGS. 2A and 2B illustrate schematic views of a drill string at two stages, with the drill string 200 including a gas probe.
FIG. 2C illustrates an enlarged schematic view of the gas probe, according to an embodiment.

The method 100 may also include boring a hole in the earth (e.g., through a subsurface formation that contains hydrogen gas) using the drill string, as at 102. FIGS. 2A and 2B illustrate schematic views of an example of the drill string 200 at two stages, with the drill string 200 including a gas probe 202 at the lower end thereof, according to an embodiment. FIG. 2C illustrates an enlarged schematic view of the gas probe 202, according to an embodiment. As shown, the drill string 200 may include one or more tubulars 204, which may terminate with a valve 216 of the gas probe 202. The drill string 200 may be part of a system for measuring the hydrogen concentration, as disclosed herein. The system may also include a manifold, collection vessel, metering device, and/or other components.

The drill string 200 may also include an adapter 206, an actuator 208, and/or a tube connection 210. The actuator 208 may be a slide hammer or another device that may be connected (e.g., threaded to) the adapter 206 and permits transmission of axial forces to the drill string 200. The tube connection 210 may provide a conduit for fluid (e.g., gases, including hydrogen) to be routed up through the drill string 200, through the tube connection 210, and to external devices connected thereto, as will be described in greater detail below. For example, tubing may be connected to the tube connection 210. The tubing may also be connected to the manifold.

Figure 3A:
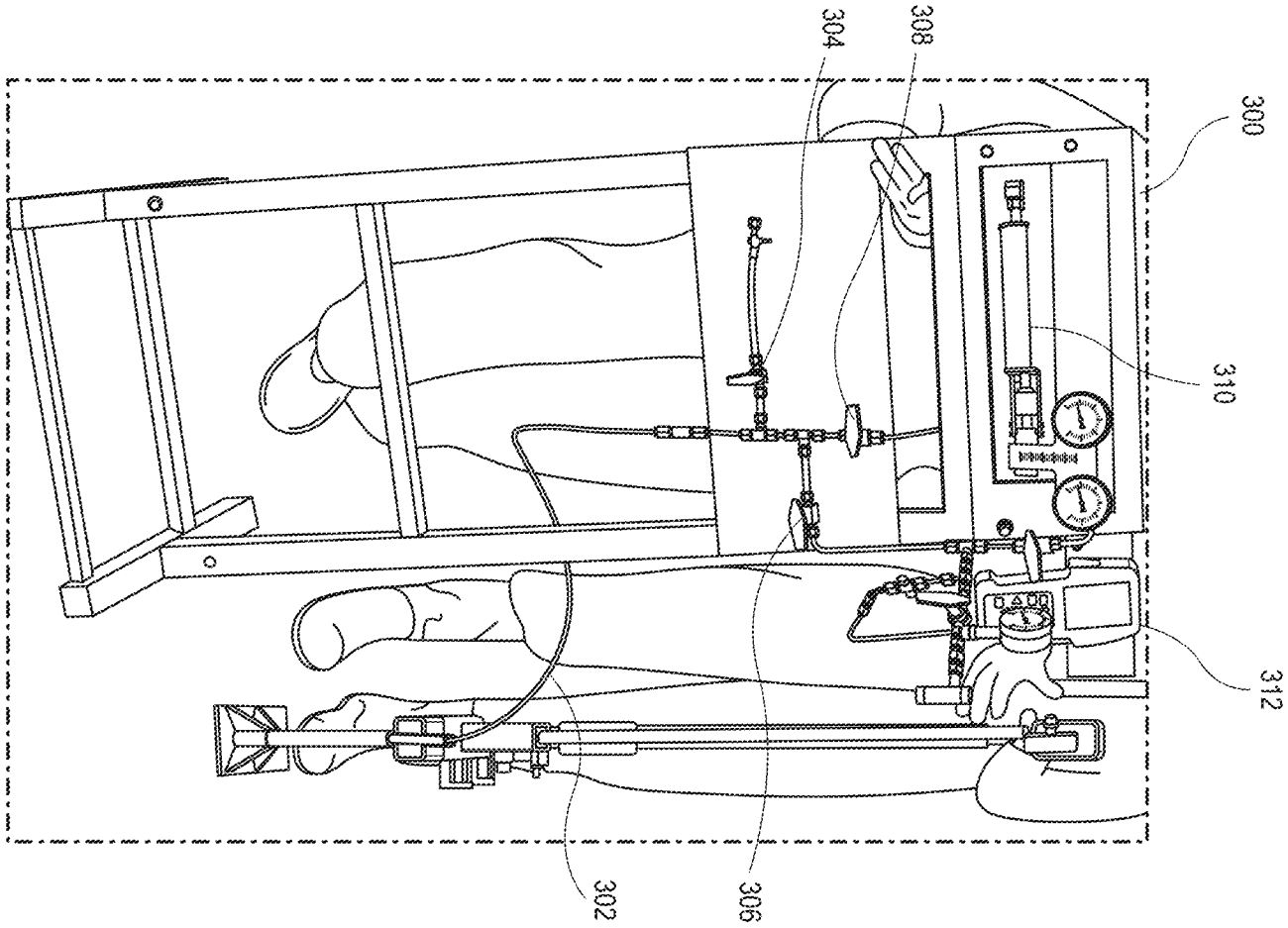
FIG. 3A illustrates an example of a manifold, according to an embodiment.
Figure 3B:
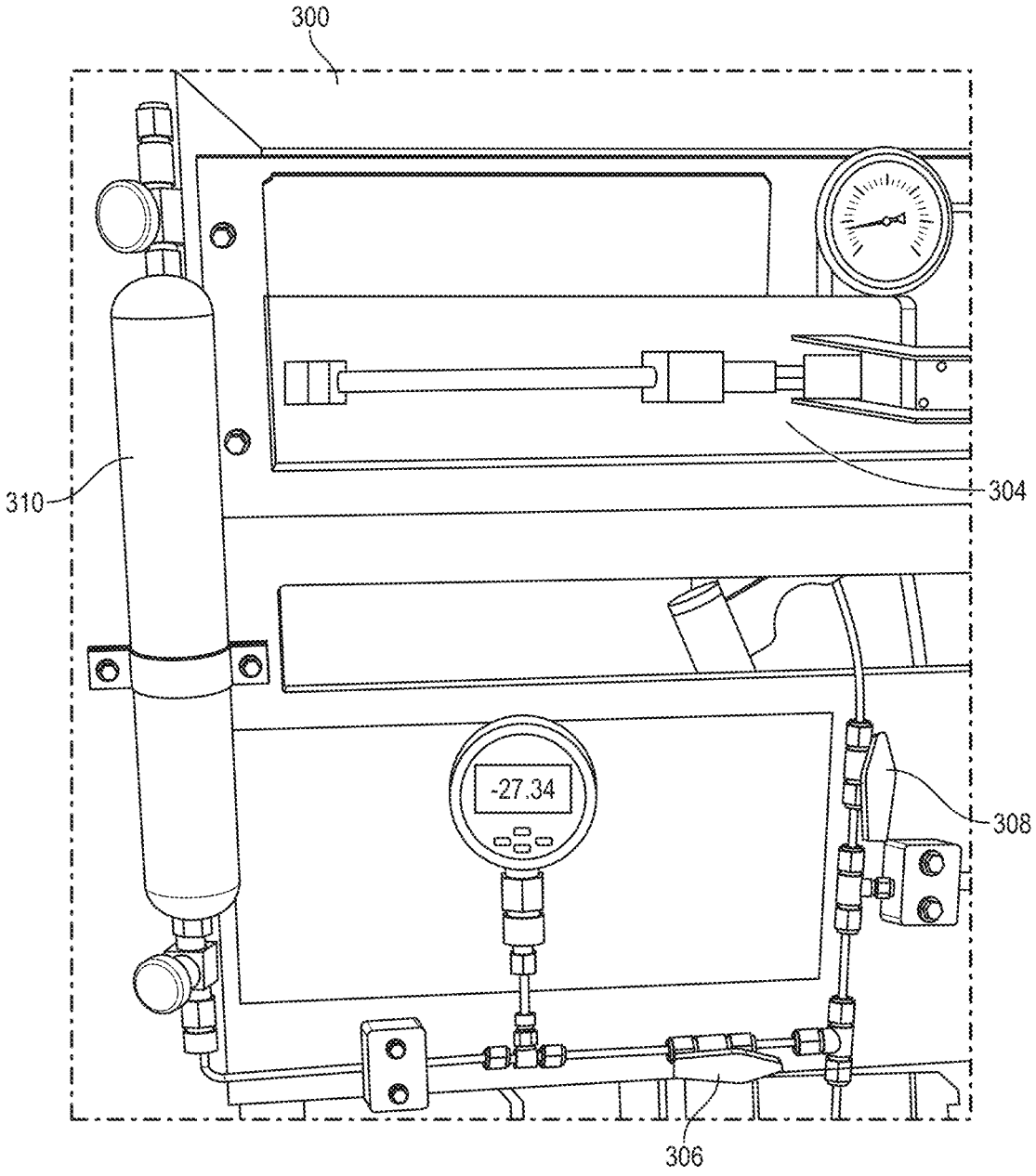
FIG. 3B illustrates another example of the manifold, according to an embodiment.

FIG. 3A illustrates an example of such a manifold 300, according to an embodiment. The manifold 300 includes the tubing, which is indicated by reference number 302. The manifold 300 also includes one or more valves (three are shown: a first valve 304, a second valve 306, and a third valve 308), a removable collection vessel 310 (in this example, an Isotube®), and a metering device 312. The metering device 312 may be configured to measure the concentration of hydrogen in gas provided thereto. FIG. 3B illustrates a similar view, but with the collection vessel 310 being a canister.

Figure 4:
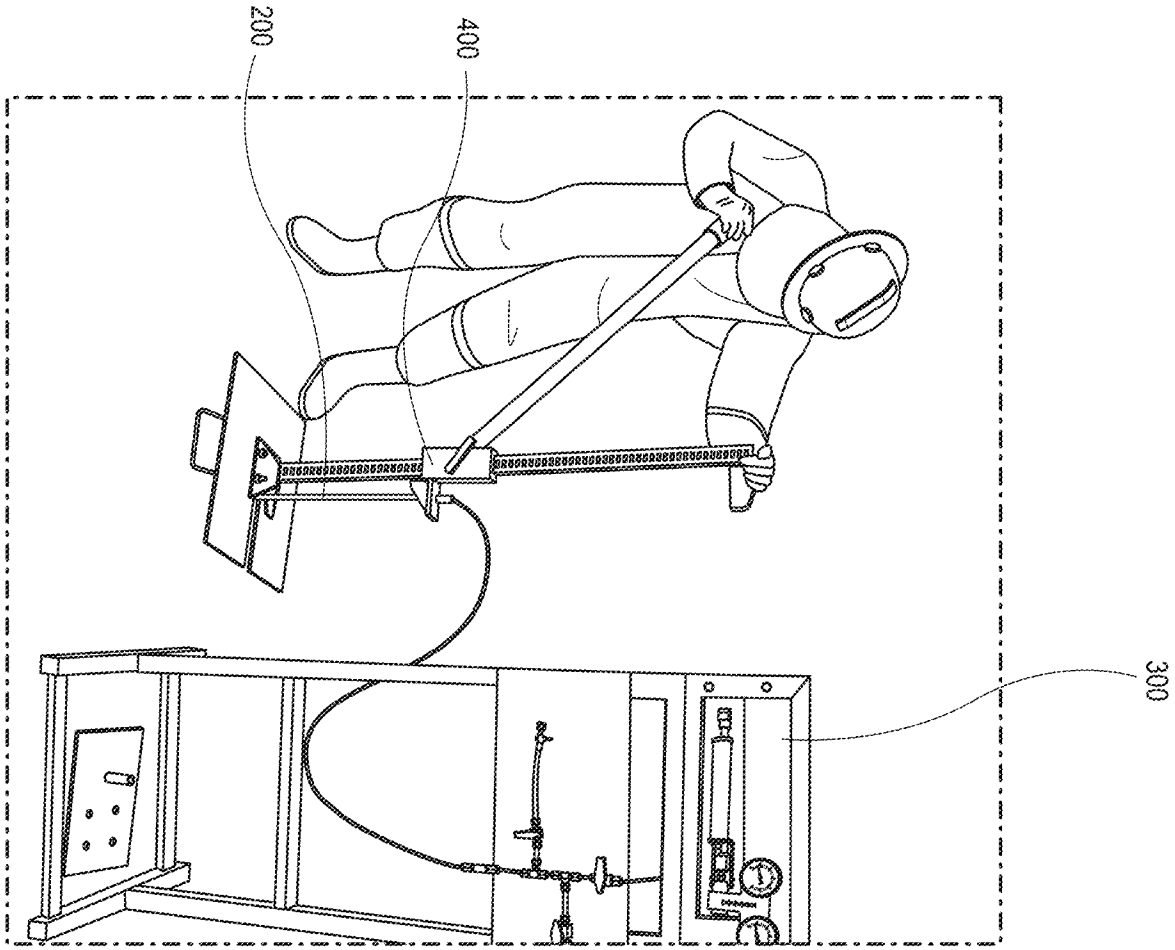
FIG. 4 illustrates a jack applied to an actuator to open a valve of the gas probe in the hole, according to an embodiment.

Again referring to FIG. 1, the method 100 may proceed to creating an opening from the gas probe 202, through the drill string 200, to the surface, as at 104. For example, referring again to FIGS. 2A and 2B, the gas probe 202 may include a tip 212, which may be pointed, formed as a helical drill bit, etc. The gas probe 202 may also include a retractable sleeve 214. An upward force on the adapter 206 may draw the retractable sleeve 214 upwards, thereby opening the valve 216 of the gas probe 202 and permitting gas to flow into the drill string 200. As shown in FIG. 4, a jack 400 may be applied to the actuator 208 to raise the sleeve 214 in the hole (i.e., wellbore).

Returning to FIG. 1, the method 100 may also include measuring gas received from the formation via the gas probe 202 using the metering device 312 (as shown in FIG. 3A e.g., before, during, or after drilling), as at 105. For example, spikes in concentration of certain gases (e.g., hydrogen) may be monitored during the drilling process, at intervals, continuously, etc.

The method 100 may also include capturing gas from the subsurface formation, as at 108. The gas may be captured from a formation through which the hole extends via the gas probe 202 and the manifold 300. The gas may be captured using a vacuum transfer process, a suction transfer process, a bag-fill transfer process, or a combination thereof. Each of these processes, according to an example, is described herein below, and may generally differ based on a source of suction that draws the gas up through the drill string. The method 100 may conclude with measuring a hydrogen concentration of the captured gas (e.g., on site, in a laboratory, etc.), as at 110.

Figure 5:
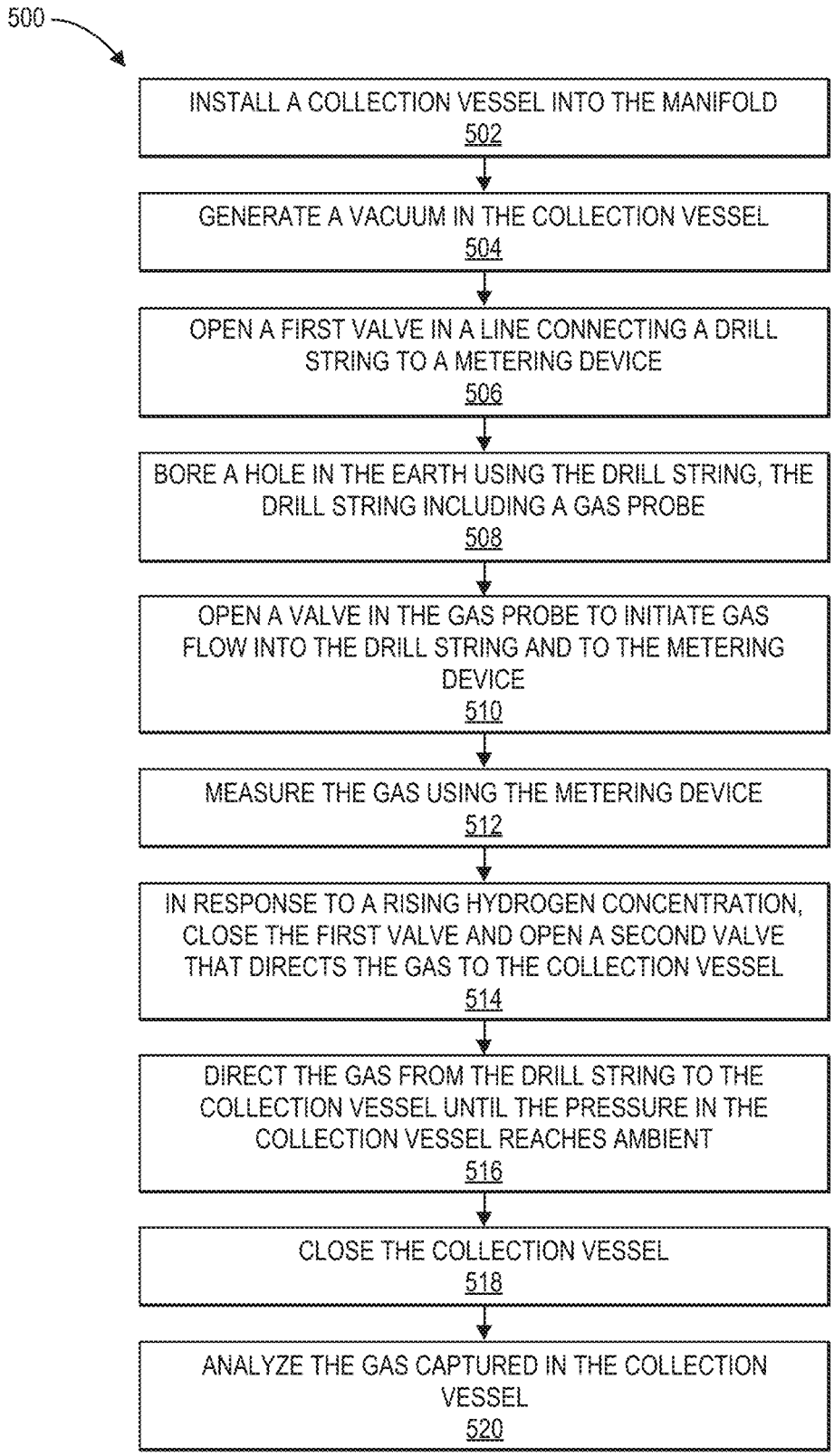
FIG. 5 illustrates a flowchart of a method for measuring hydrogen gas concentration in a subsurface formation, according to an embodiment.

FIG. 5 illustrates a flowchart of a method 500 for measuring a hydrogen (and/or another gas) concentration in a gas present in a subsurface formation, according to an embodiment. In particular, the method 500 represents an example of the vacuum transfer process. An illustrative order of the method 500 is provided below; however, one or more steps may be performed in a different order, simultaneously, repeated, or omitted.

Figure 6:
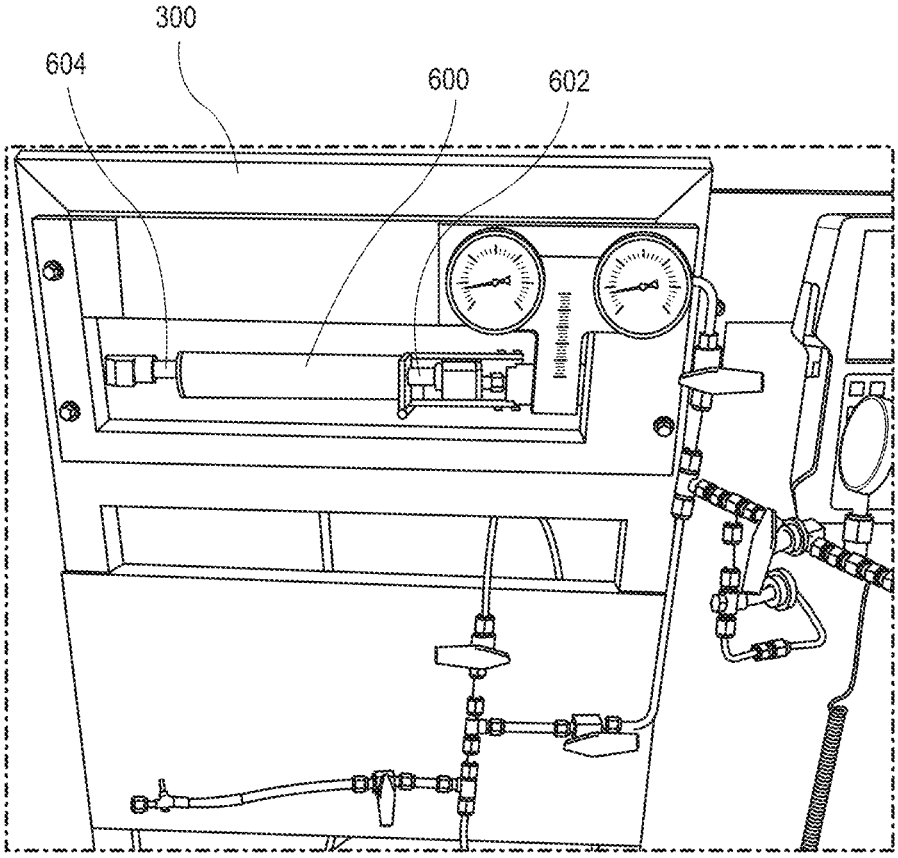
FIG. 6 illustrates an example of a collection vessel installed in the manifold, according to an embodiment.

The method 500 may begin by installing a collection vessel (e.g., an Isotube® with ports on both ends or a larger cylindrical canister) into the manifold, as at 502. FIG. 6 illustrates an example of a collection vessel 600 installed in the manifold 300. The collection vessel 600 may be a generally rigid cylindrical structure that is configured to hold gas at a pressure that is different from ambient. The collection vessel 600 may have ports on either axial end, such as an inlet port 602 on the first axial end and an outlet port 604 on the second axial end, which may permit gas to flow into or out of the collection vessel 600. Canister embodiments of the collection vessel 310 may operate similarly, except that the canister may be larger than a typical collection vessel.

Figure 7:
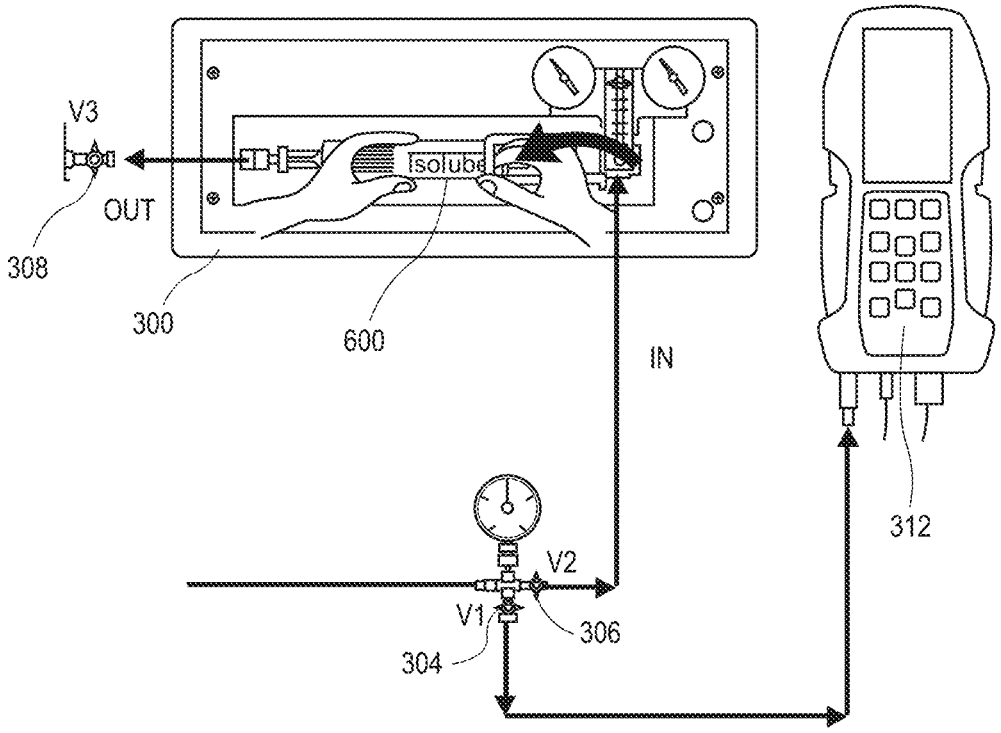
FIG. 7 illustrates a schematic depiction of the manifold including the collection vessel, a metering device, and valves, according to an embodiment.

The method 500 may also include generating a vacuum in the collection vessel, as at 504. Such vacuum may be generated prior to or after connecting the collection vessel to the manifold, and may be checked via one or more valves prior to or after installation. Referring to FIG. 7, there is shown a schematic depiction of the manifold 300 including the collection vessel 600, the metering device 312, and the valves 304, 306, 308. The first valve 304 is in a first line between the drill string and the metering device 312, the second valve 306 is in a second line between the drill string and an inlet port of the collection vessel, and a third valve 308 is coupled to an outlet valve of the collection vessel. To generate a vacuum, the valves 306 and 308 may be opened, and the valve 304 may be closed. Suction may then be applied to the collection vessel 600 via the open valve 308. Once a vacuum is achieved, the valve 306 and/or the valve 308 may be closed. Similarly, in a canister embodiment of the collection vessel 310, a vacuum may be generated in the canister and then a valve used to close the canister and maintain the vacuum until the valve is open. The canister may then be installed into the manifold.

Figure 8:
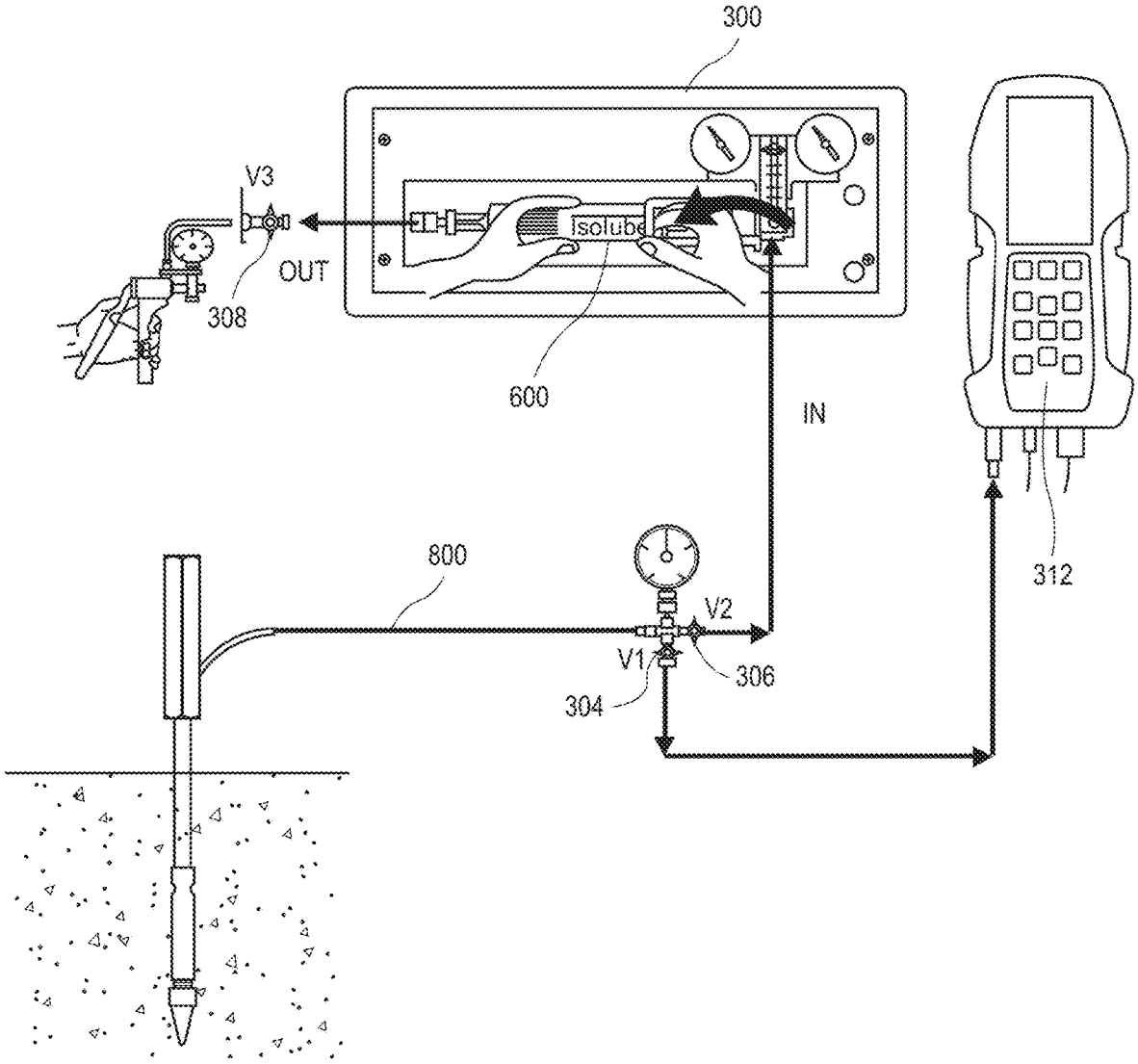
FIG. 8 illustrates another schematic depiction of the manifold, according to an embodiment.

The method 500 may then proceed to opening a valve in a line connecting a drill string to a metering device, as at 506. As shown in FIG. 8, the valve 304 may be between the metering device 312 and the drill string 200. In particular, a line 800 extends from the adapter 206 to the valve 304, which, when opened, directs gas flow to the metering device 312. The valve 304 is opened at 506.

A hole is bored in the earth using the drill string 200, as at 508. The method 500 may then proceed to opening a valve in the gas probe 202 to initiate gas flow into the drill string and to the metering device, as at 510. This may occur before, during, and/or after drilling, such that the gas may be measured using the metering device at any time before, during, and/or after the drilling operation, as at 512. Eventually, the metering device may measure an increasing hydrogen concentration in the gas being sampled from the subsurface formation, which may be a trigger to capture a sample of the gas for further analysis. Accordingly, in response to measuring an increasing hydrogen concentration (e.g., a concentration over a threshold amount), the method 500 may close the first valve and open a second valve that directs the gas to the collection vessel, as at 514. Referring again to FIG. 8, the valve 304 may be closed, stopping flow to the metering device 312. The valve 306 may then be opened, exposing the gas in the line 800 to the vacuum applied by the collection vessel 600. Accordingly, the gas from the drill string 200 may be drawn into the collection vessel 600.

The gas may be directed into the collection vessel until the collection vessel reaches a predetermined pressure (e.g., substantially ambient pressure), as at 516. The collection vessel may then be closed, as at 518. The gas received therein may be entrained within the collection vessel. The collection vessel may then be removed from the manifold and the gas captured therein may be measured (e.g., analyzed) for gas composition, as at 520.

Figure 9:
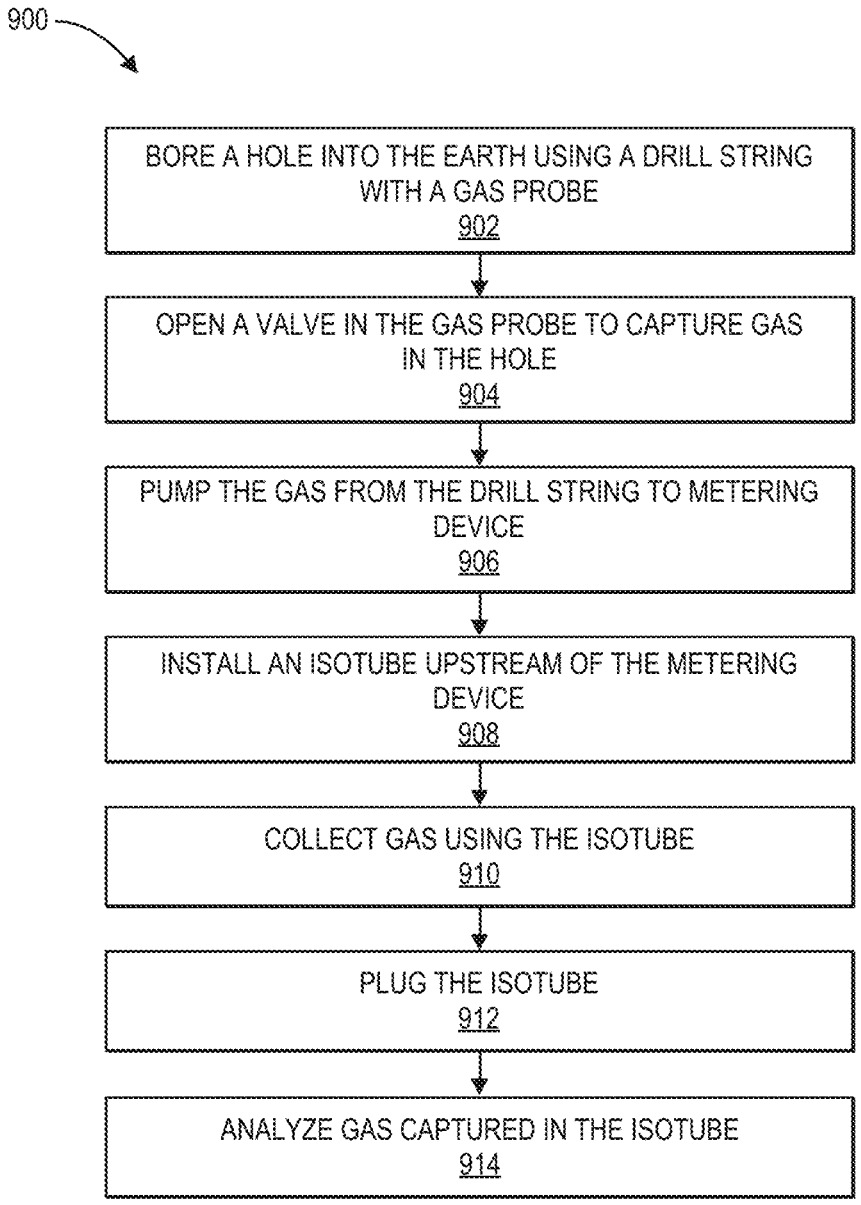
FIG. 9 illustrates a flowchart of a method for measuring the hydrogen gas concentration in the subsurface formation, according to an embodiment.

FIG. 9 illustrates a flowchart of a method 900 for measuring the hydrogen concentration in a gas present in the subsurface formation, according to an embodiment. In particular, the method 900 represents an example of the suction transfer process. An illustrative order of the method 900 is provided below; however, one or more steps may be performed in a different order, simultaneously, repeated, or omitted.

Figure 10:
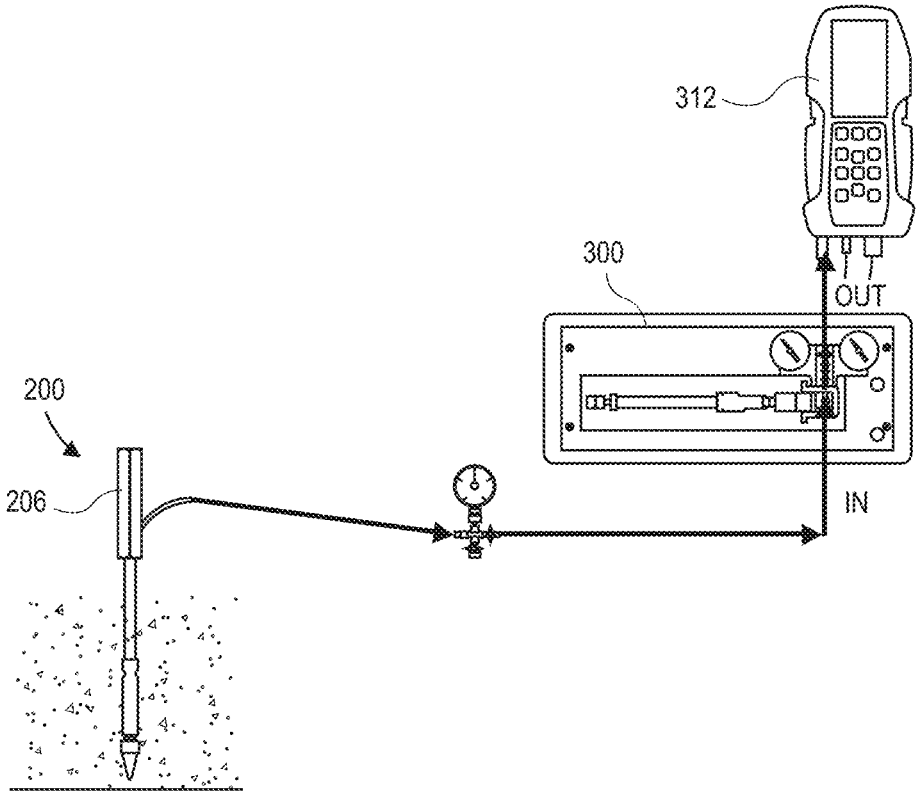
FIG. 10 schematically illustrates the manifold, which may not yet include collection vessel, connected to the drill string, according to an embodiment.

The method 900 may include boring a hole into the earth using a drill string with a gas probe, as at 902. The method 900 may also include opening a valve in the gas probe to capture gas in the hole, as at 904. In this embodiment, the gas may be pumped from the drill string to a metering device, as at 906. Such pumping may occur before, during, and/or after drilling. FIG. 10 schematically illustrates this aspect of the method 900. In particular, the manifold 300, which may not include the collection vessel at this point, is connected to the drill string 200 via the adapter 206. The manifold 300 is also connected to the metering device 312. The metering device 312 may include an internal pump, or an external pump may be coupled to the manifold 300. Such pump may draw the gas from the drill string 200 to the metering device 312.

Figure 11:
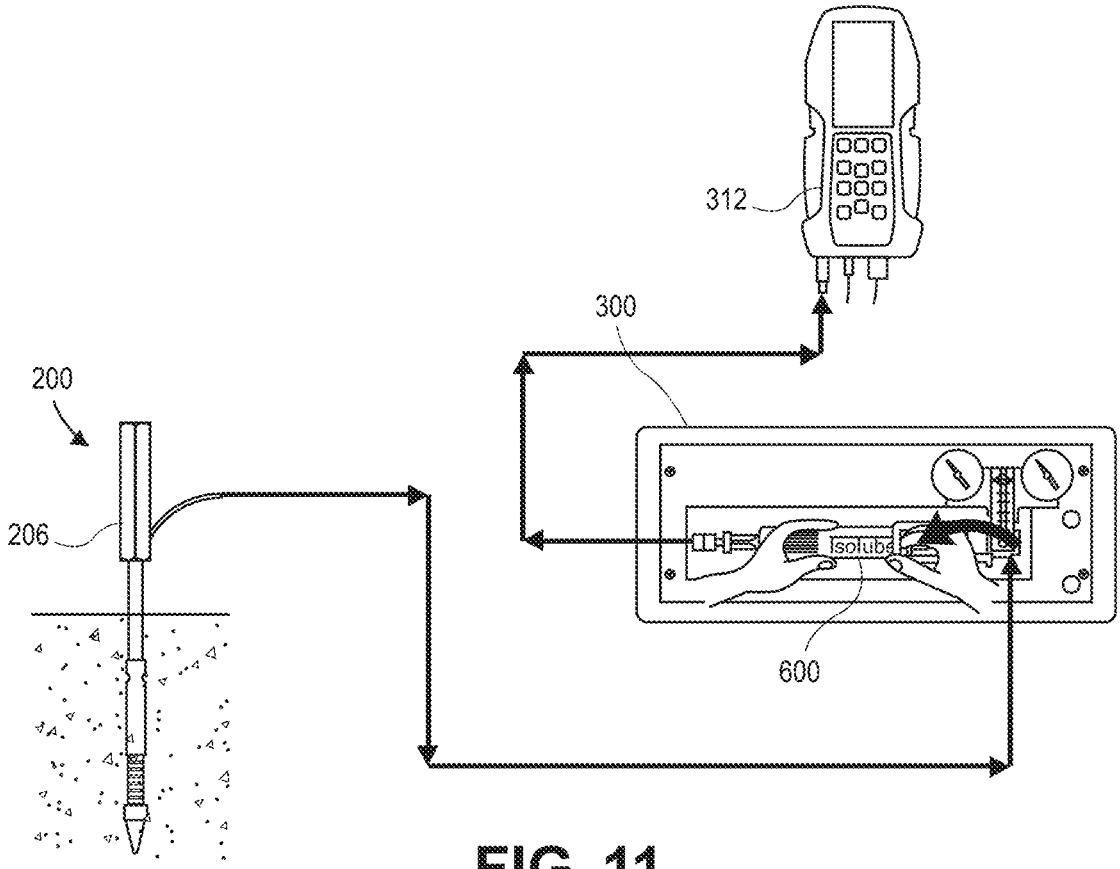
FIG. 11 schematically depicts gas being routed through the collection vessel from the drill string, according to an embodiment.

In response to the metering device 312 reading an increased hydrogen composition, or another trigger, the method 900 may proceed to installing the collection vessel, canister, or another collection device upstream of the metering device, as at 908. As shown in FIG. 11, the gas may now be routed through the collection vessel 600 from the drill string 200. Referring back to FIG. 9, the gas is collected using the collection vessel, as at 910 and the collection vessel may then be plugged, as at 912, and the gas captured therein analyzed (e.g., for hydrogen composition), as at 914.

Figure 12:
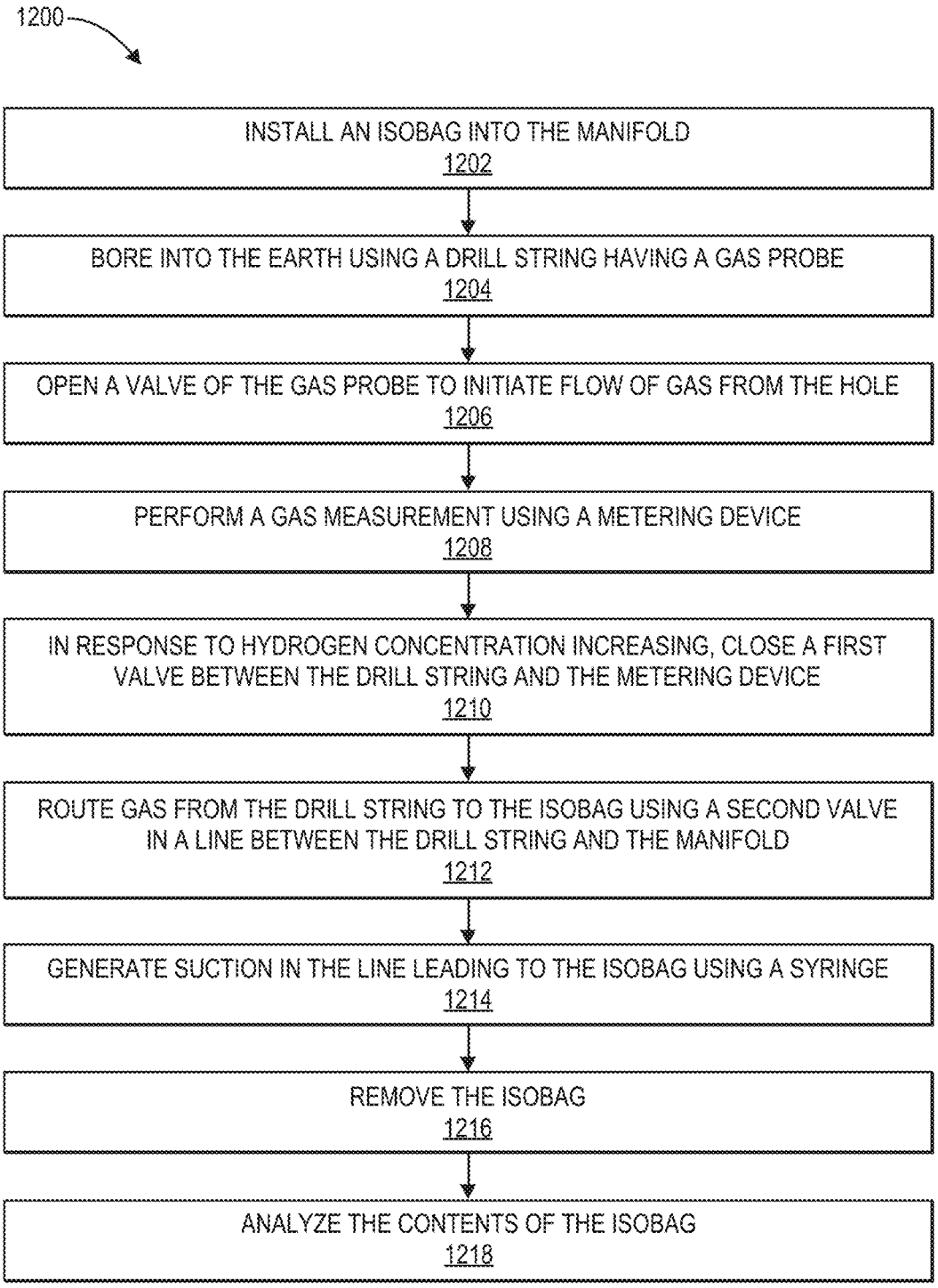
FIG. 12 illustrates a flowchart of a method for measuring the hydrogen gas concentration in a gas present in the subsurface formation, according to an embodiment.

FIG. 12 illustrates a flowchart of a method 1200 for measuring a hydrogen concentration in a gas present in a subsurface formation, according to an embodiment. In particular, the method 1200 represents an example of the bag-fill transfer process. An illustrative order of the method 1200 is provided below; however, one or more steps may be performed in a different order, simultaneously, repeated, or omitted.

Figure 13:
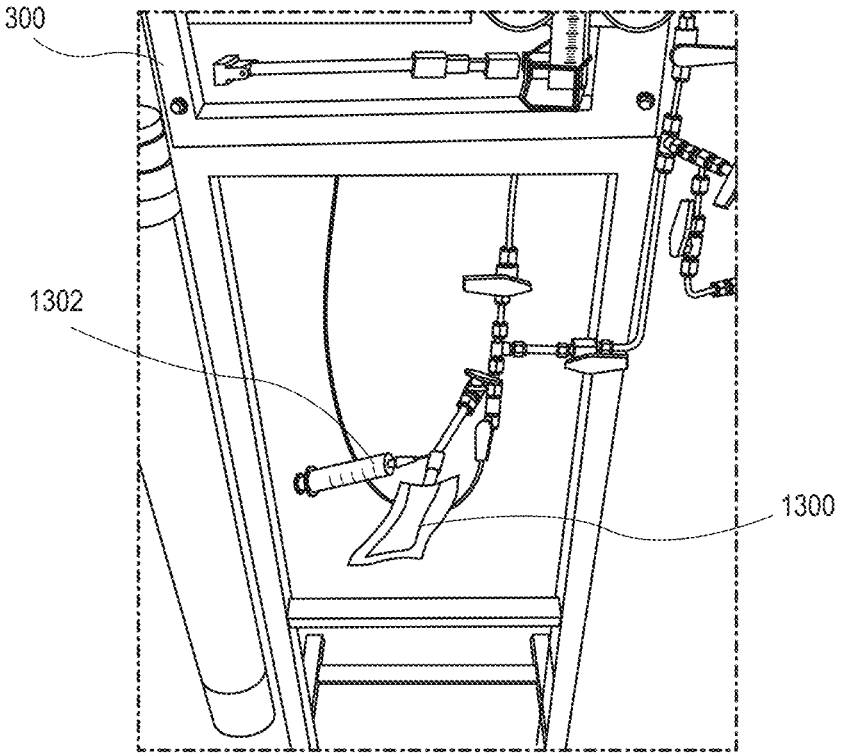
FIG. 13 illustrates the manifold including a syringe and an expandable bag, according to an embodiment.

The method 1200 may include installing an expandable bag (e.g., an Isobag®) into the manifold, as at 1202. FIG. 13 shows an expandable bag 1300 connected to the manifold 300. The expandable bag 1300 may be configured to collect and capture gas therein.

Figure 14:
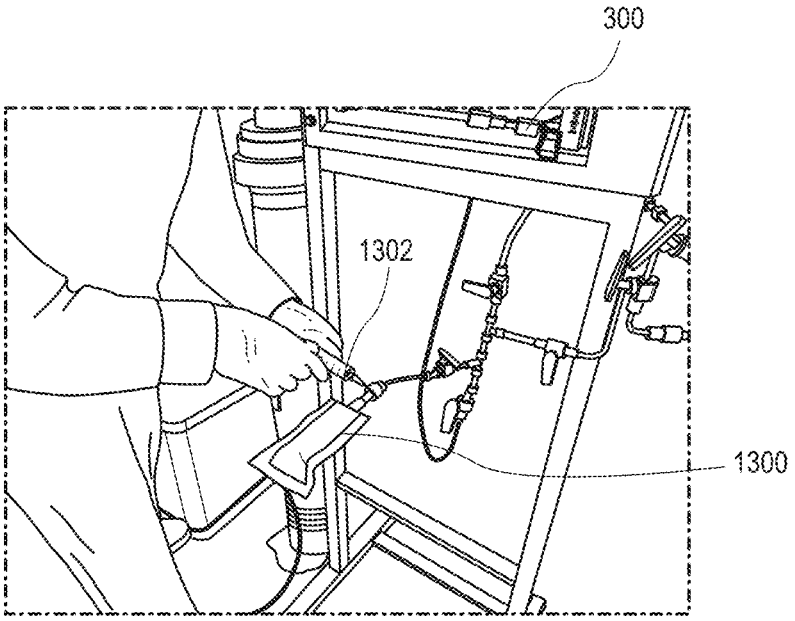
FIG. 14 illustrates the syringe being pulled to draw gas into the expandable bag, according to an embodiment.

The method 1200 may also include boring into the earth using a drill string having a gas probe, as at 1204. The method 1200 may also include opening a valve of the gas probe to initiate flow of gas from the hole, as at 1206. The gas that is recovered from the hole may be measured using a metering device (e.g., a metering device coupled with the manifold), as at 1208. In response to hydrogen concentration increasing (e.g., over a predetermined threshold), a valve between the drill string and the metering device may be closed, as at 1210. The gas from the drill string may then be routed to the expandable bag using a second valve in a line between the drill string and the manifold 1212. To draw the gas through the line and into the expandable bag, a syringe or another vacuum-pulling device may be coupled thereto and used to generate suction in the line leading to the expandable bag, as at 1214. As shown in FIG. 13, the syringe 1302 is connected to the line. Proceeding to FIG. 14, the syringe 1302 may be pulled until the syringe 1302 is full, which permits the expandable bag 1300 to collect the gas flowing through the manifold 300.

Referring again to FIG. 12, the expandable bag may then be removed, as at 1216, and the gaseous contents thereof analyzed, e.g., for hydrogen concentration, as at 1218, according to an embodiment.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method for sampling and measuring a hydrogen concentration of a gas in a subsurface formation, the method comprising:

boring a hole in the subsurface formation using a drill string, wherein a gas probe is coupled to a lower end of the drill string, wherein the gas probe comprises a retractable sleeve and a gas probe valve;

opening the gas probe to collect the gas from the subsurface formation;

drawing the gas up through the drill string after the gas probe is opened, wherein the gas is drawn up to a manifold, and wherein the manifold comprises a metering device and one or more manifold valves;

opening the gas probe valve after a first of the one or more manifold valves is opened, wherein opening the gas probe valve comprises exerting an upward force on an adapter of the drill string, wherein the adapter couples the drill string to the manifold, wherein the adapter is positioned above the gas probe, and wherein the upward force on the adapter draws the retractable sleeve upward, which opens the gas probe valve and allows the gas to flow therethrough, into the drill string, and to the metering device; and measuring the hydrogen concentration of the gas after the gas is drawn up.

2. The method of claim 1, wherein the manifold further comprises a collection vessel, wherein drawing the gas up through the drill string to the manifold comprises generating a vacuum in the collection vessel, and wherein generating the vacuum comprises:

closing the first manifold valve, wherein the first manifold valve is in a first line between the drill string and the metering device;

opening a second of the one or more manifold valves, wherein the second manifold valve is in a second line between the drill string and an inlet port of the collection vessel;

opening a third of the one or more manifold valves, wherein the third manifold valve coupled to an outlet valve of the collection vessel;

applying suction to the collection vessel while the first manifold valve is closed and the second and third manifold valves are open to generate the vacuum; and closing the second manifold valve once the vacuum is generated.

3. The method of claim 2, further comprising opening the first manifold valve after the second manifold valve is closed.

4. The method of claim 1, wherein the metering device measures the hydrogen concentration of the gas, and wherein, in response to the hydrogen concentration increasing above a predetermined threshold, the method further comprises:

closing the first manifold valve, which stops flow of the gas to the metering device; and opening the second manifold valve, which draws the gas into the collection vessel.

5. The method of claim 4, further comprising:

closing the collection vessel once the gas reaches a predetermined pressure within the collection vessel;

removing the collection vessel from the manifold after the collection vessel is closed; and analyzing the gas in the collection vessel after the collection vessel is removed.

6. The method of claim 1, wherein the drill string comprises an adapter that is coupled to the manifold, wherein the manifold is also coupled to a metering device, and wherein the concentration is measured by the metering device.

7. A method for sampling and measuring a hydrogen concentration of a gas in a subsurface formation, the method comprising:

boring a hole in the subsurface formation using a drill string, wherein a gas probe is coupled to a lower end of the drill string, wherein the drill string comprises an adapter that is coupled to a manifold, and wherein the manifold is also coupled to a metering device;

opening the gas probe to collect the gas from the subsurface formation;

drawing the gas up through the drill string after the gas probe is opened; and measuring the hydrogen concentration of the gas after the gas is drawn up, wherein the concentration is measured by the metering device, wherein, in response to the hydrogen concentration increasing above a predetermined threshold, the method further comprises:

installing a collection vessel between the drill string and the metering device, wherein the collection vessel is installed in the manifold, and wherein the gas flows from the drill string and into the collection vessel;

plugging the collection vessel once the gas flows into the collection vessel; and analyzing the gas in the collection vessel after the collection vessel is plugged.

8. The method of claim 6, wherein, in response to the hydrogen concentration increasing above a predetermined threshold, the method further comprises:

closing a first manifold valve in a first line between the drill string and the metering device;

opening a second manifold valve in a second line between the drill string and an expandable bag in the manifold;

drawing the gas into the expandable bag using a vacuum-pulling device that is coupled to the second line, wherein the vacuum-pulling device comprises a syringe;

analyzing the gas in the expandable bag.

9. A system for sampling and measuring a hydrogen concentration of a gas in a subsurface formation, the system comprising:

a drill string comprising a gas probe coupled to a lower end thereof, wherein the gas probe is configured to open, which allows the gas from the subsurface formation to flow up through the drill string; and a manifold coupled to the drill string, wherein the manifold comprises:

a metering device, wherein the metering device measures the hydrogen concentration of the gas;

a suction device;

a collection vessel, wherein the suction device draws the gas from the drill string into the collection vessel;

a first manifold valve in a first line between the drill string and the metering device;

a second manifold valve in a second line between the drill string and an inlet of the collection vessel, wherein, in response to the hydrogen concentration increasing above a predetermined threshold:

the first manifold valve closes, which stops flow of the gas to the metering device; and the second manifold valve opens, which draws the gas into the collection vessel; and a third manifold valve coupled to an outlet of the collection vessel, wherein the suction device is configured to draw the gas while the first manifold valve is closed and the second and third manifold valves are open.

10. The system of claim 9, wherein the collection vessel comprises an Isotube®, wherein the Isotube® comprises an inlet port on a first axial end thereof and an outlet port on a second axial end thereof, and wherein the Isotube® is configured to hold the gas at a pressure that is different from an ambient pressure.

11. The system of claim 9, wherein the collection vessel comprises an Isobag®.

12. The system of claim 11, wherein the suction device is coupled to the second line.

13. The system of claim 12, wherein the suction device comprises a syringe.

14. A system for sampling and measuring a hydrogen concentration of a gas in a subsurface formation, the system comprising:

a drill string comprising a gas probe coupled to a lower end thereof, wherein the gas probe comprises a retractable sleeve and a gas probe valve, wherein the gas probe is configured to open, which allows the gas from the subsurface formation to flow up through the drill string, and wherein the gas probe valve is opened by exerting an upward force on an adapter of the drill string; and a manifold coupled to the drill string, wherein the manifold comprises a metering device, a suction device, and a collection vessel, wherein the upward force on the adapter draws the retractable sleeve upward, which opens the gas probe valve and allows the gas to flow therethrough, into the drill string, and to the metering device, wherein the metering device measures the hydrogen concentration of the gas, and wherein the suction device draws the gas from the drill string into the collection vessel.

15. The system of claim 14, wherein the adapter couples the drill string to the manifold, and wherein the adapter is positioned above the gas probe.

* * * * *